US009472907B2

(12) United States Patent
Kao et al.

(10) Patent No.: US 9,472,907 B2
(45) Date of Patent: Oct. 18, 2016

(54) ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/755,479

(22) Filed: Jun. 30, 2015

(65) Prior Publication Data

US 2015/0380871 A1 Dec. 31, 2015

(30) Foreign Application Priority Data

| | | | |
|---|---|---|---|
| Jun. 30, 2014 | (TW) | ..... | 103211621 U |
| Jul. 8, 2014 | (TW) | ..... | 103123537 A |
| Nov. 27, 2014 | (TW) | ..... | 103141243 A |

(51) Int. Cl.

| | |
|---|---|
| ***H01R 13/648*** | (2006.01) |
| ***H01R 13/66*** | (2006.01) |
| ***H01R 13/6595*** | (2011.01) |
| *H01R 13/6593* | (2011.01) |
| *H01R 107/00* | (2006.01) |

(52) U.S. Cl.

CPC ..... *H01R 13/6658* (2013.01); *H01R 13/6595* (2013.01); *H01R 13/6593* (2013.01); *H01R 2107/00* (2013.01)

(58) Field of Classification Search

CPC ..... H01R 13/6658; H01R 13/6596; H01R 13/145; H01R 2107/00; H01R 13/6595; H01R 13/502; H01R 13/6581; H01R 9/038; H01R 13/41

USPC ..... 439/607.27

See application file for complete search history.

(56) References Cited

U.S. PATENT DOCUMENTS

| | | | | |
|---|---|---|---|---|
| 7,690,948 | B2 * | 4/2010 | Lung | H01R 13/41 439/607.27 |
| 7,967,631 | B2 * | 6/2011 | Wang | H01R 13/502 439/541.5 |
| 8,764,486 | B2 * | 7/2014 | Ii | H01R 9/038 439/607.46 |
| 8,870,596 | B2 * | 10/2014 | Ii | H01R 13/6581 439/607.41 |
| 2010/0035465 | A1 * | 2/2010 | Wang | H01R 13/502 439/541.5 |

* cited by examiner

*Primary Examiner* — Jean F Duverne
(74) *Attorney, Agent, or Firm* — Muncy, Geissler, Olds & Lowe, P.C.

(57) ABSTRACT

An electrical plug connector includes an insulated housing and a metallic shell. The insulated housing includes a base member, an upper portion, a lower portion and defines a mating room between the upper portion and the lower portion. The upper portion and the lower portion are extending from one side of the base member. The metallic shell encloses the insulated housing, and includes a front shell and a rear shell. The front shell includes a front cover portion and a rear cover portion. The rear cover portion is extending from a rear side of the front cover portion. The rear shell encloses the front side of the base member and includes a front extending plate propped on the rear cover portion, so that the front shell and the rear shell are fixed with each other.

16 Claims, 10 Drawing Sheets

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

21
22

Fig. 1C

ELECTRICAL PLUG CONNECTOR

CROSS-REFERENCES TO RELATED APPLICATIONS

This non-provisional application claims priority under 35 U.S.C. §119(a) on Patent Application No. 103211621, 103123537, and 103141243, filed in Taiwan, R.O.C. on 2014 Jun. 30, 2014 Jul. 8, and 2014 Nov. 27, the entire contents of which are hereby incorporated by reference.

FIELD OF THE INVENTION

The instant disclosure relates to an electrical connector, and more particularly, to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is not sufficient. As a consequence, faster serial bus interfaces, USB 3.0, are developed, which may provide a higher transmission rate so as to satisfy the need of a variety devices.

An existing USB electrical plug connector includes an insulated housing and a metallic shell, where the metallic shell covers the insulated housing to provide a shielding effect during signal transmission. In addition, conventionally, the metallic shell includes a front shell and a rear shell, and the insulated housing is enclosed by the front shell and the rear shell.

However, a conventional USB electrical plug connector usually does not have any structure between a front shell and a rear shell to effectively combine and position the two shells fixedly. In addition, a gap will be generated between the front shell and the rear shell when the two shells are improperly combined and positioned with each other. As a result, the insulated housing and terminals inside the front shell and the rear shell would be exposed. Furthermore, electromagnetic interference (EMI) and radio frequency interference (RFI) may occur.

SUMMARY OF THE INVENTION

Therefore, how to solve the problem of the conventional structure is a question that related manufacturers must think about.

In view of the foregoing problem, an exemplary embodiment of the instant disclosure provides an electrical plug connector, comprising an insulated housing, a plurality of upper-row plug terminals, a plurality of lower-row plug terminals, and a metallic shell. The insulated housing comprises a base member and defines a mating room between an upper member and a lower portion. The upper member and the lower portion are extended from one side of the base member. The upper portion has an upper mating face, the lower portion has a lower mating face, and the upper mating face is opposite to the lower mating face. The upper-row plug terminals are held in the upper portion. The upper-row plug terminals comprise a plurality of signal terminals, at least one power terminal, and at least one ground terminal. Each of the upper-row plug terminals is held in the upper portion of the insulated housing and disposed at the upper mating face of the upper portion. The lower-row plug terminals comprise a plurality of signal terminals, at least one power terminal, and at least one ground terminal. Each of the lower-row plug terminals is held in the lower portion of the insulated housing and disposed at the lower mating face of the lower portion. The metallic shell encloses the insulated housing and comprises a front shell and a rear shell. The front shell comprises a front cover portion and a rear cover portion. The front cover portion defines a receiving cavity therein to receive the upper portion and the lower portion. The rear cover portion is extending from a rear side of the front cover portion, and the base member is received in the rear cover portion. The rear shell encloses a rear side of the base member and comprises a front extending plate propped on the rear cover portion, so that the front shell and the rear shell are fixed with each other.

In sum, in embodiments of the instant disclosure, the front extending plate of the rear shell is propped on the rear cover portion, and the front extending plate and the rear cover portion are fixed by soldering techniques, so that the front shell and the rear shell are fixed with each other. In addition, the front extending plate is propped on the rear cover portion, so that gaps are not formed between the front extending plate and the rear cover portion, and a proper shielding can be provided. Therefore, the RFI problems due to poor shielding caused by the gaps between the front extending plate and the rear cover portion can be prevented. Furthermore, the front extending plate is propped on the rear cover portion, so that consistency and continuity may be kept during signal transmission between the front shell and the rear shell. Moreover, a plurality of first clamping sidewalls and a plurality of second clamping sidewalls of the metallic shell are provided to clamp on two sides of the circuit board to improve the positioning effect for the upper shell and the lower shell. Moreover, the rear shell is electrically connected to the circuit board to provide effective effects of noise conduction and grounded, therefore, the EMI problems can be improved. Furthermore, pin-assignments of the upper-row plug terminals and the lower-row plug terminals are 180 degree symmetrical, dual or double orientation design which enable the electrical plug connector to be inserted into an electrical receptacle connector in either of two intuitive orientations, i.e. In either upside-up or upside-down directions. In other words, the pin-assignments of the upper-row plug terminals and the lower-row plug terminals have 180 degree symmetrical, dual or double orientation design with respect to a central point of the receiving cavity as the symmetrical center. Consequently, the electrical plug connector is inserted into an electrical receptacle connector with a first orientation where the upper portion is facing up, for transmitting first signals; conversely, the electrical plug connector is inserted into the electrical receptacle connector with a second orientation where the upper portion is facing down, for transmitting second signals. Furthermore, the specification for transmitting the first signals is conformed to the specification for transmitting the second signals. Consequently, the inserting orientation of the electrical plug connector is not limited.

Detailed description of the characteristics and the advantages of the disclosure is shown in the following embodiments, the technical content and the implementation of the disclosure should be readily apparent to any person skilled in the art from the detailed description, and the purposes and the advantages of the disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 1C is a schematic configuration diagram of the plug terminals of the electrical plug connector shown in FIG. 1B;

DETAILED DESCRIPTION

Figure 1:
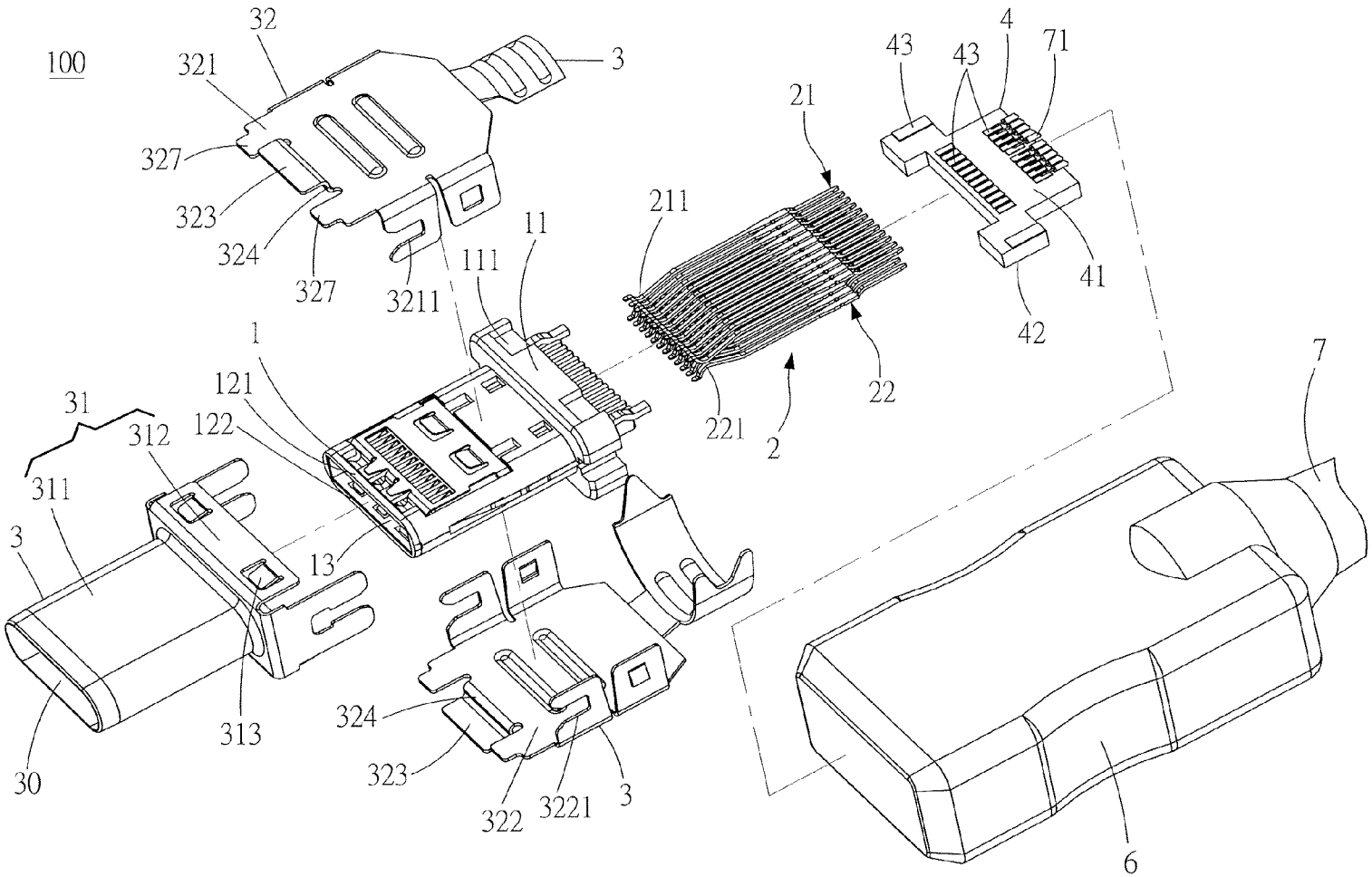
FIG. 1 is an exploded view of an electrical plug connector according to the instant disclosure.
Figure 2:
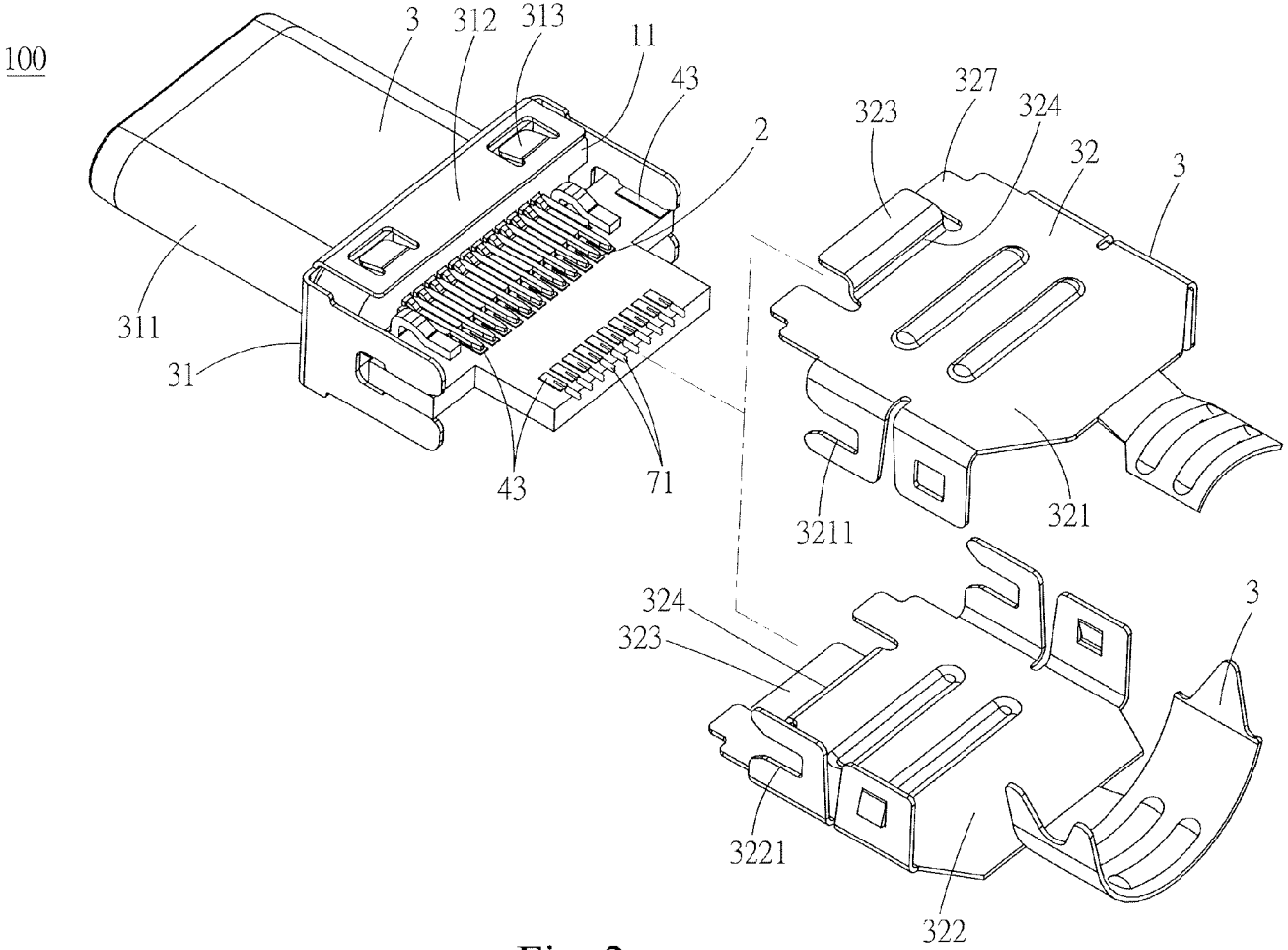
FIG. 2 is an exploded view of a front shell and a rear shell of the metallic shell of the electrical plug connector according to the instant disclosure.
Figure 3:
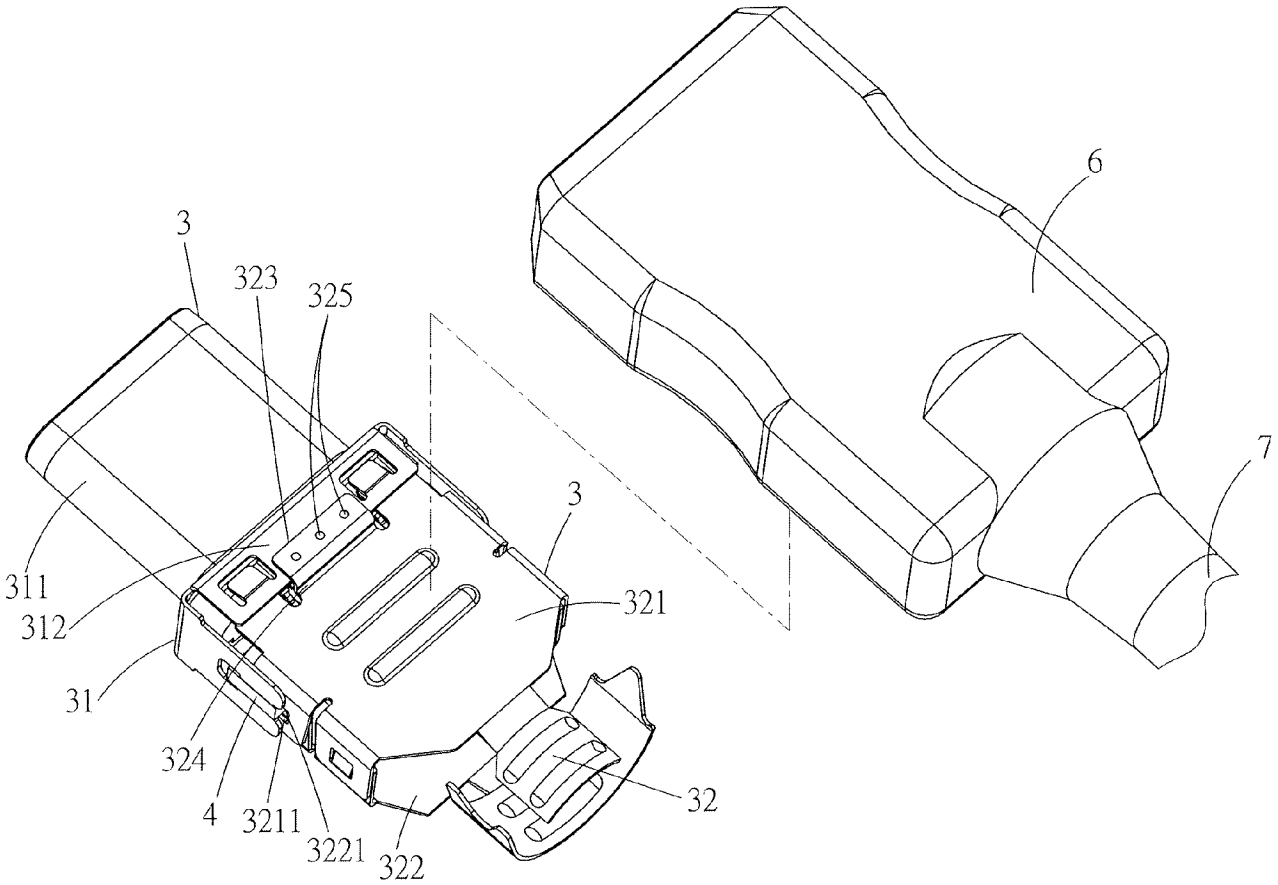
FIG. 3 is a perspective view (1) of the metallic shell and an enveloping shell of a first embodiment of the electrical plug connector according to the instant disclosure.
Figure 4:
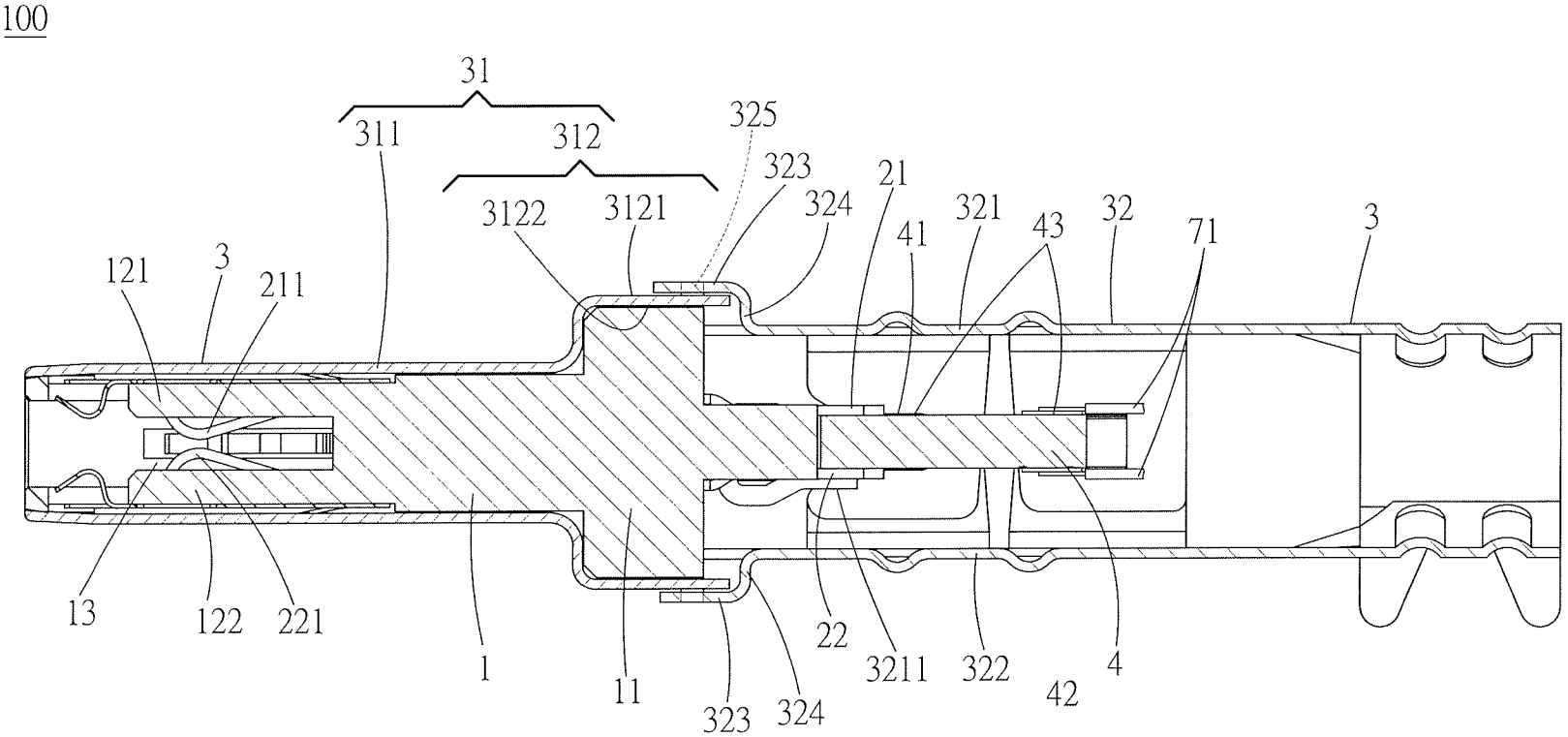
FIG. 4 is a lateral sectional view of the electrical plug connector according to the instant disclosure.

FIG. 1 is an exploded view of an electrical plug connector 100 according to the instant disclosure, FIG. 2 is an exploded view of a front shell 31 and a rear shell 32 of a metallic shell 3 of the electrical plug connector 100 according to the instant disclosure, FIG. 3 is a perspective view (1) of the metallic shell 3 and an enveloping shell 6 of a first embodiment of the electrical plug connector 100 according to the instant disclosure, and FIG. 4 is a lateral sectional view of the electrical plug connector 100 according to the instant disclosure. FIG. 1, FIG. 2, FIG. 3, and FIG. 4 illustrate an exemplary embodiment of an electrical plug connector 100 according to the instant disclosure. In this embodiment, the electrical plug connector 100 provides a reversible or dual orientation USB Type-C connector interface and pin assignments. Accordingly, a USB plug connector according to the instant disclosure can have a 180 degree symmetrical, dual, or double orientation design and pin assignments which enables the plug connector 100 to be inserted into a corresponding receptacle connector in either of two intuitive orientations, i.e. In either upside-up or upside-down directions. The electrical plug connector 100 comprises an insulated housing 1, a plurality of plug terminals 2, and a metallic shell 3.

Referring to FIGS. 1 and 4, in which the insulated housing 1 comprises a base member 11, and defines a mating room 13 between an upper portion 121 and a lower portion 122. The upper portion 121 and the lower portion 122 are extending from one side of the base member 11. The base member 11, the upper portion 121 and the lower portion 122 are formed an unitary member by injection molding technique for production of the insulated housing 1. The base member 11 also could be formed another unitary member by injection molding techniques and assembled with the upper portion 121 and the lower portion 122 for production of the insulated housing 1. Moreover, the upper portion 121 has an upper mating face 1211, the lower portion 122 has a lower mating face 1221, and the upper mating face 1211 of the upper portion 121 is opposite to the lower mating face 1221 of the lower portion 122.

Figure 1A:
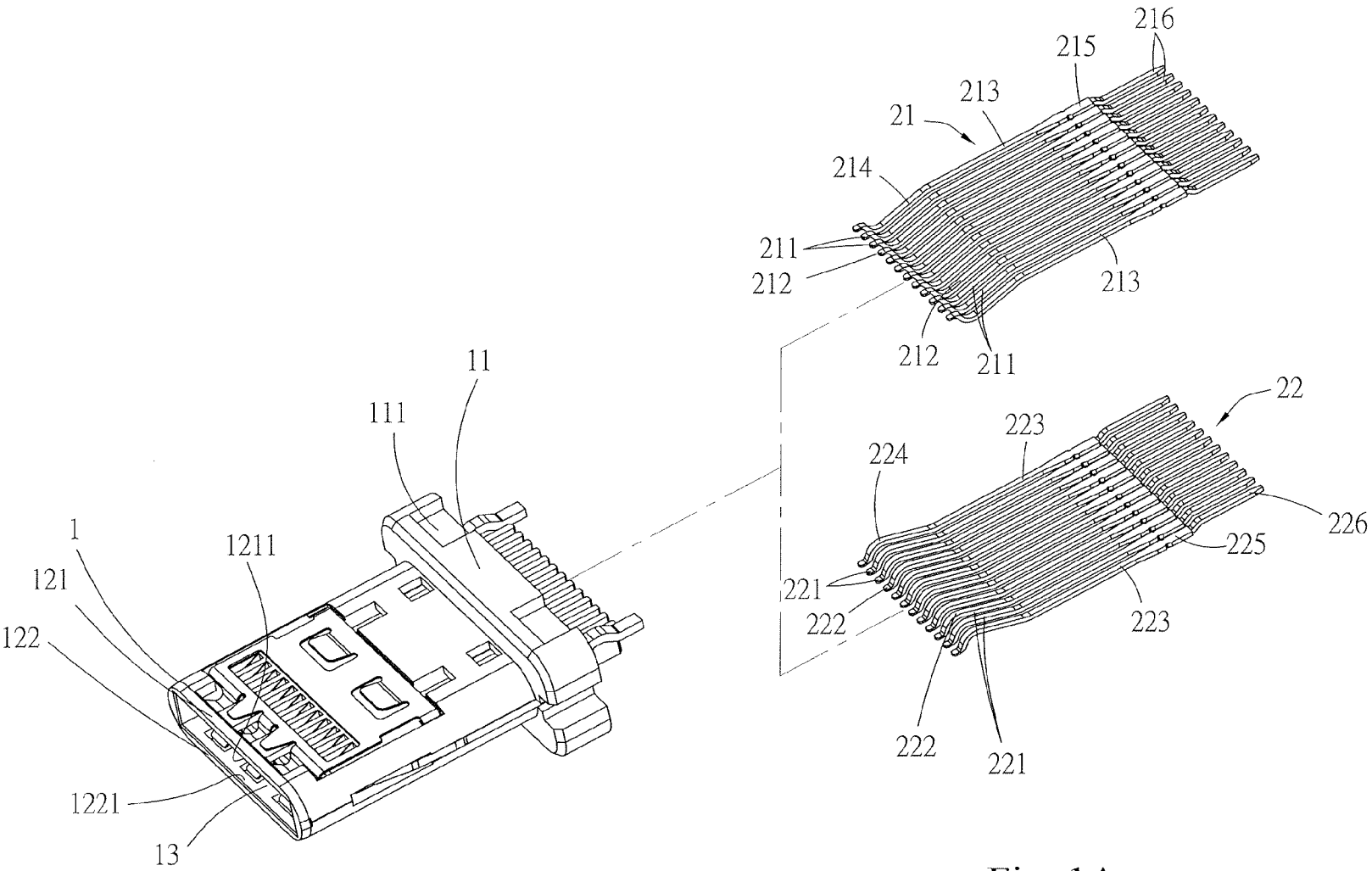
FIG. 1A is an exploded view showing an insulated housing and plug terminals of the electrical plug connector according to the instant disclosure.

Please refer to FIG. 1 and FIG. 1A. FIG. 1A is an exploded view showing the insulated housing 1 and the plug terminals 2 of the electrical plug connector 100 according to the instant disclosure. The plug terminals 2 comprise a plurality of upper-row plug terminals 21 and a plurality of lower-row plug terminals 22. The upper-row plug terminals 21 are held at the upper portion 121 and the lower-row plug terminals 22 are held at the lower portion 122.

Figure 1B:
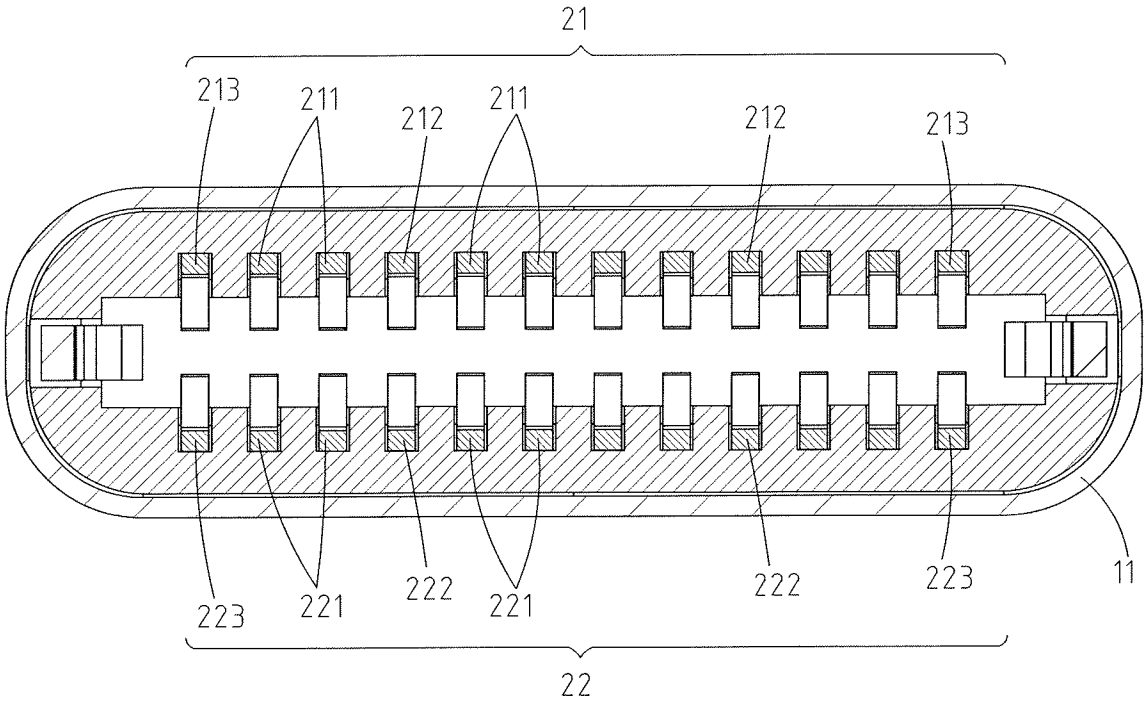
FIG. 1B is a sectional view of the electrical plug connector according to the instant disclosure.

Please refer to FIG. 1A, FIG. 1B and FIG. 1C. FIG. 1B is a sectional view of the electrical plug connector 100 according to the instant disclosure. FIG. 1C is a schematic configuration diagram of the plug terminals 2 of the electrical plug connector 100 shown in FIG. 1B. The upper-row plug terminals 21 are held in the upper portion 121. The upper-row plug terminals 21 comprise a plurality of signal terminals 211, at least one power terminal 212, and at least one ground terminal 213. Each of the upper-row plug terminals 21 is held in the upper portion 121 of the insulated housing 1 and disposed at the upper mating face 1211 of the upper portion 121. Referring to FIG. 1C, the upper-row plug terminals 21 comprise, from right to left, a ground terminal 213 (Gnd), a first pair of differential signal terminals (TX1+−), a second pair of differential signal terminals (D+−), and a third pair of differential signal terminals (RX2+−) of the signal terminals 211, power terminals 212 (Power/VBUS) between the three pairs of differential signal terminals, a retain terminal (RFU), (the retain terminal and a configuration channel 1 (CC1) are respectively arranged between the power terminals 212 and the second pair of differential signal terminals of the signal terminals 211), and another ground terminal 213 (Gnd).

Please refer to FIG. 1A, FIG. 1B and FIG. 1C. Each of the upper-row plug terminals 21 comprises a body portion 215 held in the insulated housing 1, a flexible contact portion 214 extended form one of two ends of the body portion 215 and disposed at the upper mating face 1211 of the upper portion, and a tail portion 216 extended from the other end of the body portion 215 and exposed out of the insulated housing 1. The flexible contact portions 214 of the signal terminals 211 are extending toward the mating room 13 and transmitting first signals (that is, USB 3.0 signals). The soldering segments 216 are extended from a rear portion of the insulated housing 1. Furthermore, the tail portions 216 are bent horizontally to form flat legs, named SMT legs, that can be mounted or soldered on the surface of a printed circuit board (PCB) by using surface mount technology, as shown in FIG. 1A.

Please refer to FIG. 1A, FIG. 1B and FIG. 1C. The lower-row plug terminals 22 are held in the lower portion 122. Here, the lower-row plug terminals 22 comprises a plurality of signal terminals 221, at least one power terminal 222, and at least one ground terminal 223. Each of the lower-row plug terminals 22 is held in the lower portion 122 of the insulated housing 1 and disposed at the lower mating face 1221 of the lower portion 122. Refer to FIG. 1C, the lower-row plug terminals 22 comprise, from left to right, a ground terminal 223 (Gnd), a first pair of differential signal terminals (TX2+−), a second pair of differential signal terminals (D+−), and a third pair of differential signal terminals (RX1+−) of the signal terminals 221, power terminals 222 (Power/VBUS) between the three pairs of differential signal terminals, a retain terminal (RFU), (the retain terminal and a configuration channel 2 (CC2) are respectively arranged between the power terminals 222 and the second pair of differential signal terminals of the signal terminals 221), and another ground terminal 223 (Gnd).

Please refer to FIG. 1A, FIG. 1B and FIG. 1C; in which each of the lower-row plug terminals 22 comprises a body portion 225 held in the insulated housing 1, a flexible contact portion 224 extended from one of two ends of the body portion 225 and disposed at the lower mating face 1221 of the lower portion 122, and a tail portion 226 extended from the other end of the body portion 225 and exposed out of the insulated housing 1. The flexible contact portions of the signal terminals 221 are extending toward the mating room 13 and transmitting second signals (that is, USB 3.0 signals). The tail portions 226 are extended from the rear portion of the insulated housing 1. Furthermore, the tail portions 226 are bent horizontally to form flat legs, named SMT legs, that can be mounted or soldered on the surface of a printed circuit board (PCB) by using surface mount technology, as shown in FIG. 1A.

Please refer to FIG. 1A, FIG. 1B and FIG. 1C, in which embodiment the upper-row plug terminals 21 and the lower-row plug terminals 22 are respectively at the upper mating face 1211 of the upper portion 121 and the lower mating face 1221 of the lower portion 122. Furthermore, the upper-row plug terminals 21 and the lower-row plug terminals 22 are point-symmetrical with a central point of a receiving cavity 30 as the symmetrical center. In other words, pin-assignments of the upper-row plug terminals 21 and the lower-row plug terminals 22 have 180 degree symmetrical design with respect to the central point of the receiving cavity 30 as the symmetrical center. The dual or double orientation design enables the electrical plug connector 100 to be inserted into an electrical receptacle connector in either of two intuitive orientations, i.e., in either upside-up or upside-down directions. Here, point-symmetry means, after the upper-row plug terminals 21 (or the lower-row plug terminals 22) are rotated by 180 degrees with the symmetrical center as the rotating center, the upper-row plug terminals 21 and the lower-row plug terminals 22 are overlapped. That is, the rotated upper-row plug terminals 21 are arranged at the position of the original lower-row plug terminals 22, and the rotated lower-row plug terminals 22 are arranged at the position of the original upper-row plug terminals 21. In other words, the upper-row plug terminals 21 and the lower-row plug terminals 22 are arranged upside down, and the pin assignments of the upper-row plug terminals 21 are left-right reversal with respect to the pin assignments of the lower-row plug terminals 22. Accordingly, the electrical plug connector 100 is inserted into an electrical receptacle connector with a first orientation where the upper portion 121 of the insulated housing 1 of the electrical plug connector 100 is facing up, for transmitting first signals; conversely, the electrical plug connector 100 is inserted into the electrical receptacle connector with a second orientation where the upper portion 121 of the insulated housing 1 of the electrical plug connector 100 is facing down, for transmitting second signals. The specification for transmitting the first signals conforms to that for transmitting the second signals. Based on this, the inserting orientation of the electrical plug connector 100 is not limited.

Please refer to FIG. 1A, FIG. 1B and FIG. 1C again; in which embodiment positions of upper-row plug terminals 21 correspond to positions of the lower-row plug terminals 22.

Referring back to FIG. 1, FIG. 2, and FIG. 4, in which the metallic shell 3 is a hollow shell, the metallic shell 3 encloses the insulated housing 1. That is, the insulated housing 1 is received inside the metallic shell 3. In this embodiment, the metallic shell 3 is a multi-piece member, and the metallic shell 3 comprises a front shell 31 and a rear shell 32. The front shell 31 comprises a front cover portion 311 and a rear cover portion 312. The front cover portion defines a receiving cavity 30 therein to receive the upper portion 121 and the lower portion 122. The rear cover portion 312 is extending from a rear side of the front cover portion 311 and extending backwardly. That is, the rear cover portion 312 is at the rear portion of the front cover body 311. The base member 11 is received in the rear cover portion 312. Here, the front cover portion 311 and the rear cover portion 312 are formed by the same member. That is, the front cover portion 311 and the rear cover portion 312 are formed integrally.

Furthermore, the rear shell 32 encloses a rear side of the base member 11. The rear shell 32 comprises a front extending plate 323 extending from a periphery of the middle part of the front side of the rear shell 32 and extending forwardly. In this embodiment, the front extending plate 323 is propped on the rear cover portion 312, so that the front shell 31 and the rear shell 32 are fixed with each other. In addition, the width of the front extending plate 323 is smaller than the width of the rear cover portion 312, but the instant disclosure is not limited thereto. In some implementation aspects, the width of the front extending plate 323 may be approximately equal to the width of the rear cover portion 312. That is, the front extending plate 323 may substantially cover on the rear cover portion 312. Furthermore, after the front extending plate 323 and the rear cover portion 312 are fixed with each other, the front extending plate 323 and the rear cover portion 312 may be combined with each other due to the large-area overlapping therebetween, so that a proper fixing between the front shell 31 and the rear shell 32 can be achieved.

Figure 5:
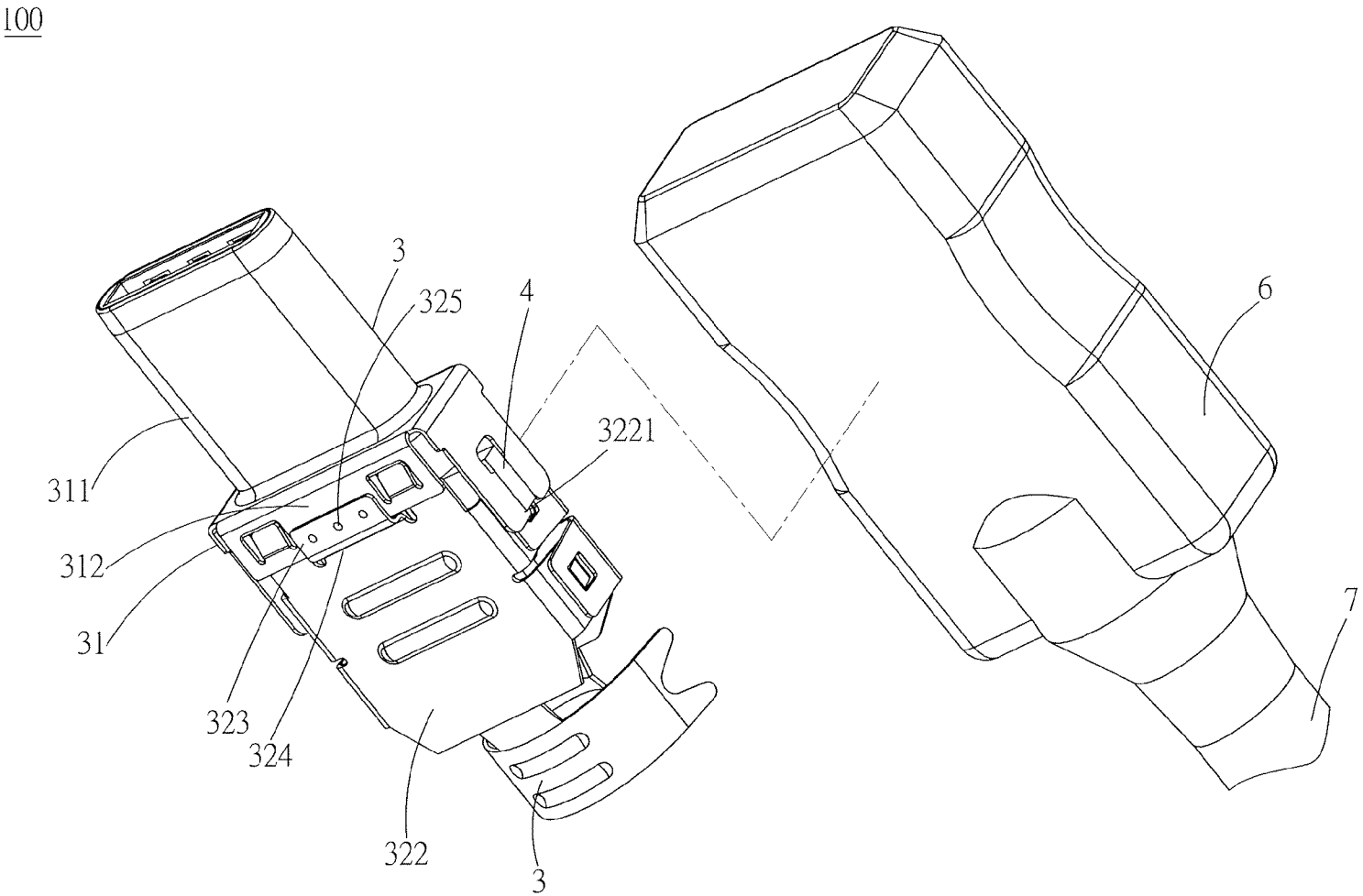
FIG. 5 is a perspective view (2) of the metallic shell and the enveloping shell of the first embodiment of the electrical plug connector according to the instant disclosure.
Figure 6:
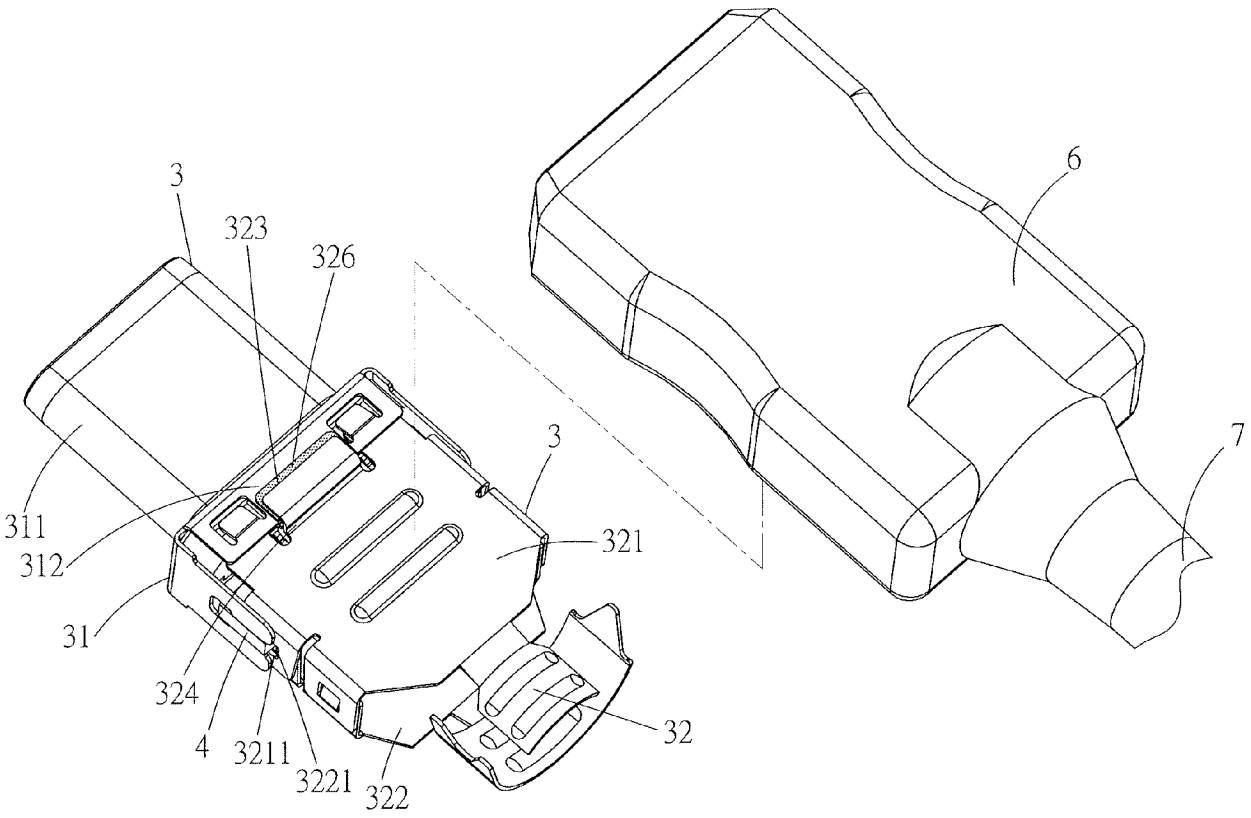
FIG. 6 is a perspective view of the metallic shell and the enveloping shell of the first embodiment of the electrical plug connector according to the instant disclosure.
Figure 7:
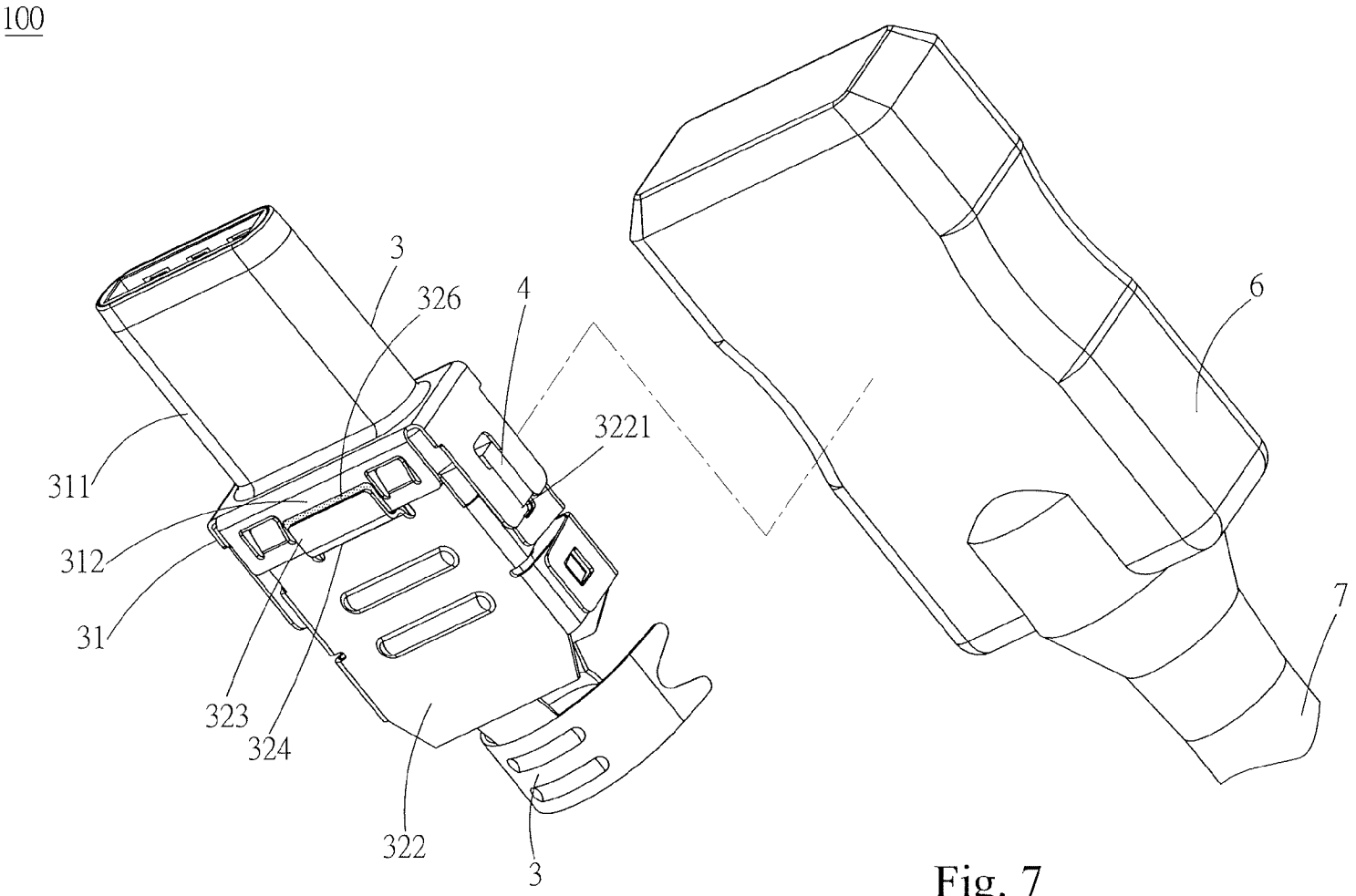
FIG. 7 is a perspective view (2) of the metallic shell and the enveloping shell of the first embodiment of the electrical plug connector according to the instant disclosure.

FIG. 5 is a perspective view (2) of the metallic shell 3 and the enveloping shell 6 of the first embodiment of the electrical plug connector 100 according to the instant disclosure, for one implementation aspect. Further referring to FIG. 2, FIG. 3, and FIG. 5, when the front shell 31 encloses the insulated housing 1, the rear cover portion 312 encloses of the base member 11. And then, the rear shell 32 is combined with the front shell 31, so that the front extending plate 323 of the rear shell 32 is propped on the rear cover portion 312, and the front extending plate 323 and the rear cover portion 312 are stacked with other. Here, several fixing methods are provided. In one implementation aspect, the rear shell 32 may comprise a plurality of connection points 325 formed on the surface of the front extending plate 323 by proper welding techniques, so that the front extending plate 323 and the rear cover portion 312 are welded and fixed with each other. That is, a laser beam welding process is applied to the surface of the front extending plate 323 to connect and to secure the front extending plate 323 with the rear cover portion 312. The laser beam welding process may be performed to the surface of the front extending plate 323, so that the connecting points 325 are formed on the surface of the front extending plate 323, and the connection points 325 are fixed with the rear cover portion 312. Therefore, the front extending plate 323 and the rear cover portion 312 are integrated and tightly fixed with each other. In another implementation aspect, the rear shell 32 comprises a plurality of connection segments 326 (as shown in FIG. 6 and FIG. 7) formed at a periphery of the front extending plate 323 by tin-soldering technique, so that the periphery of the front extending plate 323 and the surface of the rear cover portion 312 are fixed with each other. That is, a tin-soldering process is applied to the periphery of the front extending plate 323 to solder and fix the front extending plate 323 with the rear cover portion 312. Tin-soldering technique is applied to the periphery of the front extending plate 323, so that the soldered segment of the periphery of the front extending plate 323 is soldered and fixed with the surface of the rear cover portion 312, therefore the front extending plate 323 and the rear cover portion 312 are integrated and tightly fixed with each other. In further another implementation aspect, the front extending plate 323 comprises an abutting sheet (not shown) abutted against the rear cover portion 312, so that the front extending plate 323 and the rear cover portion 312 are tightly combined and fixed with each other. In yet another implementation aspect, the rear cover portion 312 comprises an abutting sheet (not shown) abutted against the front extending plate 323, so that the front extending plate 323 and the rear cover portion 312 are tightly combined and fixed with each other.

In the instant disclosure, the front extending plate 323 is propped on the rear cover portion 312, so that consistency and continuity may be kept during signal transmission between the front shell 31 and the rear shell 32. In addition, the front extending plate 323 is propped on the rear cover portion 312, and the front extending plate 323 and the rear cover portion 312 are fixed together, so that gaps may be not formed between the front extending plate 323 and the rear cover portion 312, and a proper shielding effect can be provided. Therefore, the RFI problems due to poor shielding caused by the gaps between the front extending plate 323 and the rear cover portion 312 can be prevented.

Further referring to FIG. 1, FIG. 2, and FIG. 4; in which embodiment, the insulated housing 1 further comprises a circuit board 4 and an enveloping shell 6. The circuit board 4 is combined on the rear side of the base member 11, and the enveloping shell 6 and a transmission wire 7 are then provide to enclose the circuit board 4. In addition, the metallic shell 3 encloses the circuit board 4 to protect the circuit board 4. After a wire material 71 of the transmission wire 7 is soldered on the circuit board 4, a proper overmolding process is applied over the circuit board 4 to prevent electronic components soldered on the circuit board 4 from being damaged. For example, during applying glue to the interior of the metallic shell 3, the metallic shell 3 protects electronic components soldered on the circuit board 4 on the circuit board 4 from being damaged.

Here, the rear shell 32 comprises an upper shell 321 and a lower shell 322 that are secured with each other, and the upper shell 321 and the lower shell 322 are above and below the circuit board 4, respectively. The upper shell 321 further comprises a plurality of first clamping sidewalls 3211 clamped at two sides of the circuit board 4. The lower shell 322 further comprises a plurality of second clamping sidewalls 3221, and the second clamping sidewalls 3221 are approximately partially overlapped with the first clamping sidewalls 3211 and are clamped at the two sides of the circuit board 4.

In addition, further referring to FIG. 1, FIG. 2, and FIG. 4; in which embodiment, the circuit board 4 further comprises an upper surface 41, a lower surface 42, and a plurality of contacts 43 at two sides of the upper surface 41 and two sides of the lower surface 42, respectively. When the upper shell 321 and the lower shell 322 of the rear shell 32 are combined on the circuit board 4, the first clamping sidewalls 3211 and the second clamping sidewalls 3221 may be in contact with the contacts 43, so that the rear shell 32 is electrically connected to the circuit board 4 to effectively conduct and ground noises, thereby mitigating the EMI problem.

Further referring to FIG. 1, FIG. 2, and FIG. 4, in some embodiments, the rear cover portion 312 further comprises a top surface 3121 and a rear surface 3122, and the front extending plate 323 is propped on the top surface 3121 or the rear surface 3122. That is, the front extending plate 323 shown in FIG. 2 is propped on the top surface 3121, but the instant disclosure is not limited thereto. In one implementation aspect, the front extending plate 323 may also be propped on the rear surface 3122. The propping allows the front extending plate 323 and the rear cover portion 312 to stack with each other, and then the front extending plate 323 and the rear cover portion 312 can be fixed together by applying a proper machining process.

Further referring to FIG. 1, FIG. 2, and FIG. 4, in some embodiments, the rear shell 32 further comprises a bending segment 324 extending from a front end thereof and extending toward the front extending plate 323. The bending segment 324, the rear shell 32, and the front extending plate 323 are formed as a unitary member. The position of the front extending plate 323 on the rear shell 32 can be changed by the bending segment 324, so that the horizontal position of the front extending plate 323 can be changed to enable the front extending plate 323 to be propped on the rear cover portion 312 stably. In addition, during the formation of the bending segment 324 on the rear shell 32, cracks are formed at two sides of the front extending plate 323 so as to facilitate the process for forming the bending segment 324 on the front extending plate 323.

Further referring to FIG. 1, FIG. 2, and FIG. 4, in some embodiments, the base member 11 further comprises a plurality of recessed portions 111 on two sides of an upper surface and two sides of a lower surface of the base member 11. The rear shell 32 further comprises a plurality of positioning plates 327 extending from two sides of the front end of the rear shell 32 and extending forwardly, respectively. Each of the positioning plates 327 is at two sides of the front extending plate 323 and positioned in the corresponding recessed portion 111, so that the rear shell 32 and the base member 11 can fixed with each other. That is, the positioning plates 327 are respectively positioned in the recessed portions 111 to prevent the lateral movement of the rear shell 32. In addition, the front shell 31 further comprises a plurality of abutting plates 313 extending from a surface of the rear cover portion 312 and extending toward the recessed portions 111 and positioned in the recessed portions 111. That is, the abutting plates 313 are deflectedly extending toward the interior of the recessed portions 111, respectively. Moreover, the abutting plates 313 are at the rear case body 312 to extend to and abut against inner side surfaces of the recessed portions 111, respectively. Therefore, the abutting plates 313 are positioned above the positioning plates 327 to prevent the positioning plates 327 from detaching off the recessed portions 111.

In sum, in embodiments of the instant disclosure, the front extending plate of the rear shell is propped on the rear cover portion, and the front extending plate and the rear cover portion are fixed by soldering techniques, so that the front shell and the rear shell are fixed with each other. In addition, the front extending plate is propped on the rear cover portion, so that gaps are not formed between the front extending plate and the rear cover portion, and a proper shielding can be provided. Therefore, the RFI problems due to poor shielding caused by the gaps between the front extending plate and the rear cover portion can be prevented. Furthermore, the front extending plate is propped on the rear cover portion, so that consistency and continuity may be kept during signal transmission between the front shell and the rear shell. Moreover, a plurality of first clamping side walls and a plurality of second clamping sidewalls of the metallic shell are provided to clamp on two sides of the circuit board to improve the positioning effect for the upper shell and the lower shell. Moreover, the rear shell is electrically connected to the circuit board to provide effective effects of noise conduction and grounded. Therefore, the EMI problems can be improved. Furthermore, pin-assignments of the upper-row plug terminals and the lower-row plug terminals are 180 degree symmetrical, dual or double orientation design which enable the electrical plug connector to be inserted into an electrical receptacle connector in either of two intuitive orientations, i.e. In either upside-up or upside-down directions. In other words, the pin-assignments of the upper-row plug terminals and the lower-row plug terminals have 180 degree symmetrical, dual or double orientation design with respect to a central point of the receiving cavity as the symmetrical center. Consequently, the electrical plug connector is inserted into an electrical receptacle connector with a first orientation where the upper portion is facing up, for transmitting first signals; conversely, the electrical plug connector is inserted into the electrical receptacle connector with a second orientation where the upper portion is facing down, for transmitting second signals. Furthermore, the specification for transmitting the first signals is conformed to the specification for transmitting the second signals. Consequently, the inserting orientation of the electrical plug connector is not limited.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

an insulated housing comprising a base member, an upper portion, and a lower portion, wherein a mating room is defined between the upper portion and the lower portion, the upper portion has an upper mating face, the lower portion has a lower mating face, and the upper mating face is opposite to the lower mating face;

a plurality of upper-row plug terminals held in the upper portion, wherein the upper-row plug terminals comprise a plurality of signal terminals, at least one power terminal, and at least one ground terminal, each of the upper-row plug terminals is held in the upper portion of the insulated housing and disposed at the upper mating face of the upper portion;

a plurality of lower-row plug terminals held in the lower portion, wherein the lower-row plug terminals comprise a plurality of signal terminals, at least one power terminal, and at least one ground terminal, each of the lower-row plug terminals is held in the lower portion of the insulated housing and disposed at the lower mating face of the lower portion; and a metallic shell, wherein the insulated housing is received inside the metallic shell, comprising:

a front shell comprising a front cover portion and a rear cover portion, wherein the front cover portion defines a receiving cavity therein to receive the upper portion and the lower portion, the rear cover portion is extending from a rear side of the front cover portion, and the base member is received in the rear cover portion; and a rear shell enclosing a rear side of the base member, wherein the rear shell comprises at least one front extending plate propped on the rear cover portion, so that the front shell and the rear shell are fixed with each other.

2. The electrical plug connector according to claim 1, wherein the insulated housing comprises a circuit board combined at the rear side of the base member.

3. The electrical plug connector according to claim 2, wherein the rear shell comprises an upper shell and a lower shell, the upper shell is above the circuit board, the lower shell is below the circuit board and combined with the upper shell, the upper shell comprises at least one front extending plate propped on the rear cover portion, the lower shell comprises at least one front extending plate propped on the rear cover portion, the upper shell comprises a plurality of first clamping sidewalls clamped on two sides of the circuit board, and the lower shell comprises a plurality of second clamping sidewalls partially overlapped with the first clamping sidewalls and clamped on the two sides of the circuit board.

4. The electrical plug connector according to claim 3, wherein the circuit board comprises an upper surface, a lower surface, and a plurality of contacts, and the contacts are at two sides of the upper surface and at two sides of the lower surface, respectively, and the contacts are respectively in contact with the first clamping sidewalls and the second clamping sidewalls.

5. The electrical plug connector according to claim 1, wherein the rear cover portion comprises a top surface and a rear surface, and the front extending plate is propped on the top surface or the rear surface.

6. The electrical plug connector according to claim 1, wherein the rear shell comprises a bending segment extending from a front end thereof and extending toward the front extending plate.

7. The electrical plug connector according to claim 1, wherein the rear shell comprises a plurality of connection points soldered at the front extending plate to fix the front extending plate and the rear cover portion with each other.

8. The electrical plug connector according to claim 1, wherein the rear shell comprises a plurality of connection segments soldered at a periphery of the front extending plate to fix the front extending plate and the rear cover portion with each other.

9. The electrical plug connector according to claim 1, wherein the base member comprises a plurality of recessed portions, and the rear shell comprises a plurality of positioning plates extending from two sides of a front end of the rear shell and at two sides of the front extending plate, the positioning plates are positioned in the recessed portions, respectively.

10. The electrical plug connector according to claim 9, wherein the front shell comprises a plurality of abutting plates extending from a surface of the rear cover portion and extending toward the recessed portions and positioned in the recessed portions, respectively.

11. The electrical plug connector according to claim 1, wherein each of the upper-row plug terminals comprises:

a body portion held in the insulated housing;

a flexible contact portion, extended from one of two ends of the body portion and disposed at the upper mating face of the upper portion; and a tail portion extended from the other end of the body portion and exposed out of the insulated housing.

12. The electrical plug connector according to claim 1, wherein each of the lower-row plug terminals comprises:

a body portion held in the insulated housing;

a flexible contact portion, extended from one of two ends of the body portion and disposed at the lower mating face of the lower portion; and a tail portion extended from the other end of the body portion and exposed out of the insulated housing.

13. The electrical plug connector according to claim 1, wherein the upper-row plug terminals and the lower-row plug terminals have 180 degree symmetrical design with respect to a central point of the receiving cavity as the symmetrical center.

14. The electrical plug connector according to claim 1, wherein the upper portion and the lower portion are extended from one side of the base member.

15. The electrical plug connector according to claim 1, wherein the base member, the upper portion and the lower portion, and the receptacle are formed an unitary member by injection molding techniques for production of the insulated housing.

16. The electrical plug connector according to claim 1, wherein the base member is formed an unitary member by injection molding techniques and assembled with the upper portion and the lower portion for production of the insulated housing.

* * * * *